US007398044B2

(12) United States Patent
Masuda et al.

(10) Patent No.: US 7,398,044 B2
(45) Date of Patent: Jul. 8, 2008

(54) FIXING DEVICE

(75) Inventors: Takehiro Masuda, Nagoya (JP); Yoshiya Tomatsu, Kasugai (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 10/941,897

(22) Filed: Sep. 16, 2004

(65) Prior Publication Data

US 2005/0084302 A1 Apr. 21, 2005

(30) Foreign Application Priority Data

Sep. 16, 2003 (JP) ..... 2003-322463

(51) Int. Cl.
*G03G 15/20* (2006.01)

(52) U.S. Cl. ..... 399/322; 399/323

(58) Field of Classification Search ..... 399/323, 399/322

See application file for complete search history.

(56) References Cited

U.S. PATENT DOCUMENTS 5,138,391 A * 8/1992 Takahashi et al. ..... 399/323
5,293,202 A 3/1994 Adachi et al.
5,366,291 A 11/1994 Nakagama et al.
5,528,351 A * 6/1996 Tsuji ..... 399/322
6,640,062 B2 * 10/2003 Tsubaki et al. ..... 399/323
2001/0036377 A1 * 11/2001 Tsujihara ..... 399/322
2002/0037186 A1 * 3/2002 Tanaka ..... 399/322
2002/0057919 A1 * 5/2002 Tomatsu ..... 399/69
2003/0063916 A1 * 4/2003 Katayanagi et al. ..... 399/328
2003/0210933 A1 * 11/2003 Mouri et al. ..... 399/323

FOREIGN PATENT DOCUMENTS

EP 1146401 A2 * 10/2001
JP 2-208679 A 8/1990
JP 4-166880 A 6/1992
JP 5-187927 A 7/1993
JP 10207274 A * 8/1998
JP 11-153923 A 6/1999
JP 2000-98775 A 4/2000

* cited by examiner

*Primary Examiner*—David M Gray
*Assistant Examiner*—Ryan D. Walsh
(74) *Attorney, Agent, or Firm*—Oliff & Berridge, PLC

(57) ABSTRACT

A thermistor is disposed confronting a surface of a heat roller on a downstream side in a rotational direction of a heat roller from a contact position between the heat roller and a pressure roller. Side guide members are provided on both sides of the thermistor and spaced away from the thermistor in the axial direction of the heat roller, and a regulating guide member is disposed connecting the side guide members on the downstream side in the rotational direction of the heat roller. In addition, a separation plate for separating a sheet of paper is provided at a predetermined space from the surface of the heat roller between the contact position and the thermistor in the rotational direction.

35 Claims, 11 Drawing Sheets

| SPACE BETWEEN SEPARATION PLATE AND SURFACE OF HEAT ROLLER | 0.4 TO 0.5 mm | | 0.7 TO 0.8 mm | |
|---|---|---|---|---|
| FIXING TEMPERATURE | LEADING-EDGE MARGIN: 2 TO 3 mm | LEADING-EDGE MARGIN: 1 TO 2 mm | LEADING-EDGE MARGIN: 2 TO 3 mm | LEADING-EDGE MARGIN: 1 TO 2 mm |
| 180°C | ○ | ○ | ○ | ○ |
| 175°C | ○ | × | × | × |
| 170°C | × | × | × | × |
| 165°C | × | × | × | × |

○: NO JAM OCCURRED.
×: JAM OCCURRED.

FIXING DEVICE

BACKGROUND OF THE INVENTION

1. Field of the Invention

The present invention relates to a fixing device and an image forming device provided with the fixing device.

2. Description of Related Art

An image forming device such as a laser printer is usually provided with a fixing device that has a heat roller and a pressure roller, and a toner image that has been transferred onto paper is thermally fixed as the paper passes between the heat roller and. the pressure roller.

To prevent the paper from rolling around the heat roller in such a fixing device, it is known to provide a plurality of separation claws at positions along the axial direction of the heat roller. The plurality of separation claws are disposed on the side that is further downstream in the rotational direction of the heat roller from the contact portion between the heat roller and the pressure roller, so that the paper is separated from the heat roller by the separation claws after the fixing.

As disclosed in Japanese patent-application publication (kokai) No. HEI-2-208679, it is also known to provide a separation guide having a very small space from a rotational body for fixing (that is, a heat roller) within an image area and to bring the separation guide into contact with the rotational body outside the maximum image area so that the paper is separated from the rotational body by the separation guide.

In such a fixing device, a halogen heater is provided within the heat roller and a thermistor is provided in the neighborhood of the surface of the heat roller. The fixing temperature of the heat roller is set by controlling the halogen heater based on the temperature detected by the thermistor.

The thermistor is provided further downstream in the rotational direction of the heat roller and does not normally come into contact with the paper. However, if the paper is not peeled off or separated from the heat roller by the separation claws, it is possible that the paper will be conveyed onward until the paper comes into contact with the thermistor and the thermistor could be deformed thereby.

For that reason, Japanese patent-application publication (kokai) No. 2000-98775 proposes to provide deformation prevention members in the heat roller at portions corresponding to the thermistor on the upstream and downstream sides in the rotational direction, to prevent deformation of the thermistor by guiding the paper that has not been separated from the heat roller along the heat roller by the deformation prevention member.

SUMMARY OF THE INVENTION

However, since the separation guide in the method disclosed in Japanese patent-application publication (kokai) No. HEI-2-208679 is not in contact with the heat roller, problems can be prevented such as damage and wear of the separation guide and the heat roller or the adhesion of dirt or developer to the separation guide. However, since it is necessary to form the gap between the separation guide and the surface of the heat roller small enough to prevent the paper from intruding therein, it requires strict dimensional accuracy and attachment between the separation guide and the rotational body for fixing (heat roller).

If a gap is formed between the separation guide and the heat roller, the paper could intrude toward the thermistor side without separating from the heat roller. With the method disclosed in Japanese patent-application publication (kokai) No. 2000-98775, the paper is guided by the deformation prevention members on the upstream and downstream sides of the heat roller in the rotational direction, thereby avoiding contact with the thermistor in the vicinity of the upstream and downstream sides thereof. However, since there is no configuration for guiding the paper, the paper may not be smoothly guided by the two separate deformation prevention members and may come into contact with the thermistor in the space therebetween. In particular, since the thermistor is disposed between the two deformation prevention members, it is necessary that the paper be guided reliably therebetween.

In addition, with the above-described configuration, when paper has jammed after passing below the thermistor and the paper is pulled out from the downstream side towards the upstream side, the paper may come into contact with the thermistor and damage the same.

In view of the above-described drawbacks, it is an objective of the present invention to provide a fixing device and an image forming device provided with the fixing device that prevents damage to a temperature detecting unit caused by contact between the temperature detecting unit and a fixing medium that has not been separated from a heating member and has intruded therein.

In order to attain the above and other objects, the present invention provides a fixing device for fixing a developer image onto a fixing medium. The fixing device includes a heating member, a pressure member, a temperature detecting portion, and at least one guide member. The heating member extends in its axial direction and has a heating surface. The heating surface has a temperature. The pressure member is in pressure contact with the heating member. The temperature detecting portion disposed confronts the heating surface for detecting the temperature of the. heating surface. The at least one guide member is disposed adjacent to the heating surface with a predetermined space therebetween and spaced away from the temperature detecting portion in the axial direction, thereby guiding, along the heating surface, the fixing medium that has not been separated from the heating surface and has been conveyed into the vicinity of the temperature detecting portion.

The present invention also provides a fixing device for fixing a developer image onto a fixing medium. The fixing device includes a heating member, a pressure member, a temperature detecting portion, a support member, and a separating member. The heating member extends in its axial direction and has a heating surface. The heating surface has a temperature. The pressure member is in pressure contact with the heating member at a contact position. The temperature detecting portion is disposed confronting the heating surface for detecting the temperature of the heating surface. The support member rotatably supports the heating member. The separating member is disposed downstream from the contact position in the rotating direction of the heating member and upstream from the temperature detecting portion. The separating member includes a separating portion and a positioning portion. The separating portion confronts the heating surface for separating the fixing medium from the heating surface after the developer image has been fixed onto the fixing medium. The positioning portion contacts with the support member, thereby maintaining a distance between the separating portion and the heating surface at a predetermined separation distance L.

The present invention also provides a fixing device for fixing a developer image onto a fixing medium. The fixing device includes a heating member, a pressure member, a temperature detecting portion, a cover member, and at least one guide member. The heating member extends in its axial direction and has a heating surface. The heating surface has a temperature. The pressure member is in pressure contact with the heating member. The temperature detecting portion is disposed confronting the heating surface for detecting the temperature of the heating surface. The cover member covers the heating member. The at least one guide member is disposed at the cover member and adjacent to the heating surface with a predetermined space therebetween, thereby guiding, along the heating surface, the fixing medium that has not been separated from the heating surface and has been conveyed into the vicinity of the temperature detecting portion.

The present invention also provides a fixing device for fixing a developer image onto a fixing medium. The device includes a heating member, a pressure member, a temperature detecting portion, a cover member, and a. regulating member. The heating member extends in its axial direction and has a heating surface. The heating surface has a temperature. The pressure member is in pressure contact with the heating member. The temperature detecting portion is disposed confronting the heating surface for detecting the temperature of the, heating surface. The cover member covers the heating member. The regulating member is disposed at the cover member and downstream of the temperature detecting portion in the rotating direction of the heating member with a space from the heating surface. The regulating member extends in a direction that intersects with a direction perpendicular to the axial direction.

The present invention also provides a fixing device for fixing a developer image onto a fixing medium. The fixing device includes a heating member, a pressure member, a temperature detecting portion, a separating member, and a control unit. The heating member extends in its axial direction and has a heating surface. The heating surface has a temperature. The pressure member is in pressure contact with the heating member at a contact position. The temperature detecting portion is disposed confronting the heating surface for detecting the temperature of the heating surface. The separating member is disposed downstream from the contact position in the rotating direction of the heating member and upstream from the temperature detecting portion, thereby separating the fixing medium from the heating surface after the developer image has been fixed onto the fixing medium. The control unit controls the temperature of the s heating surface such that a space between the heating surface and a leading edge of the thinnest fixing medium for which fixing can be performed is greater than a space between the heating surface and the separating member, allowing the separating member to separate the leading edge of the thinnest fixing medium from the heating surface.

The present invention also provides an image forming device. The image forming device includes an image bearing member, a transfer unit, and a fixing device. The image bearing member bears a developer image formed by developing an electrostatic latent image. The transfer unit transfers the developer image borne on the image bearing member to a fixing medium. The fixing device includes a heating member, a pressure member, a temperature detecting portion, and at least one guide member. The heating member extends in its axial direction and has a heating surface. The heating surface has a temperature. The pressure member is in pressure contact with the heating member. The temperature detecting portion is disposed confronting the heating surface for detecting the temperature of the heating surface. The at least one guide member is disposed adjacent to the heating surface with a predetermined space therebetween and spaced away from the temperature detecting portion in the axial direction, thereby guiding, along the heating surface, the fixing medium that has not been separated from the heating surface and has been conveyed into the vicinity of the temperature detecting portion.

In this way, the removal member is disposed accurately at a predetermined space from the heating member, thereby preventing the intrusion of the fixing medium and also guiding the fixing medium so that the fixing medium does not come into contact with the temperature detecting unit if the fixing medium is not separated and is conveyed onward.

BRIEF DESCRIPTION OF THE DRAWINGS

The above and other objects, features and advantages of the invention will become more apparent from reading the following description of the preferred embodiments taken in connection with the accompanying drawings in which:

FIG. 5(*b*) is an enlarged perspective view showing a receiving portion of a bearing member;

FIG. 5(*c*) is an enlarged perspective view showing a positioning portion of a separation plate;

FIG. 7(*b*) is a further enlarged cross-sectional view showing a separation plate that is disposed such that a back surface thereof confronts a surface of the heat roller;

FIG. 8(*b*) is an explanatory diagram showing a state in which the paper has passed through between the separation plate and the surface of the heat roller and is being guided by the guide plate;

FIG. 9(*b*) is an explanatory diagram showing a state in which jamming has occurred in paper that has been guided to the downstream side of the thermistor in the rotational direction of the heat roller;

DETAILED DESCRIPTION OF THE PREFERRED EMBODIMENTS

A fixing device and an image forming device according to a preferred embodiment of the present invention will be described while referring to the accompanying drawings.

First, the overall structure of a laser printer 1 according to an embodiment of the present invention will be described with reference to FIG. 1.

Figure 1:
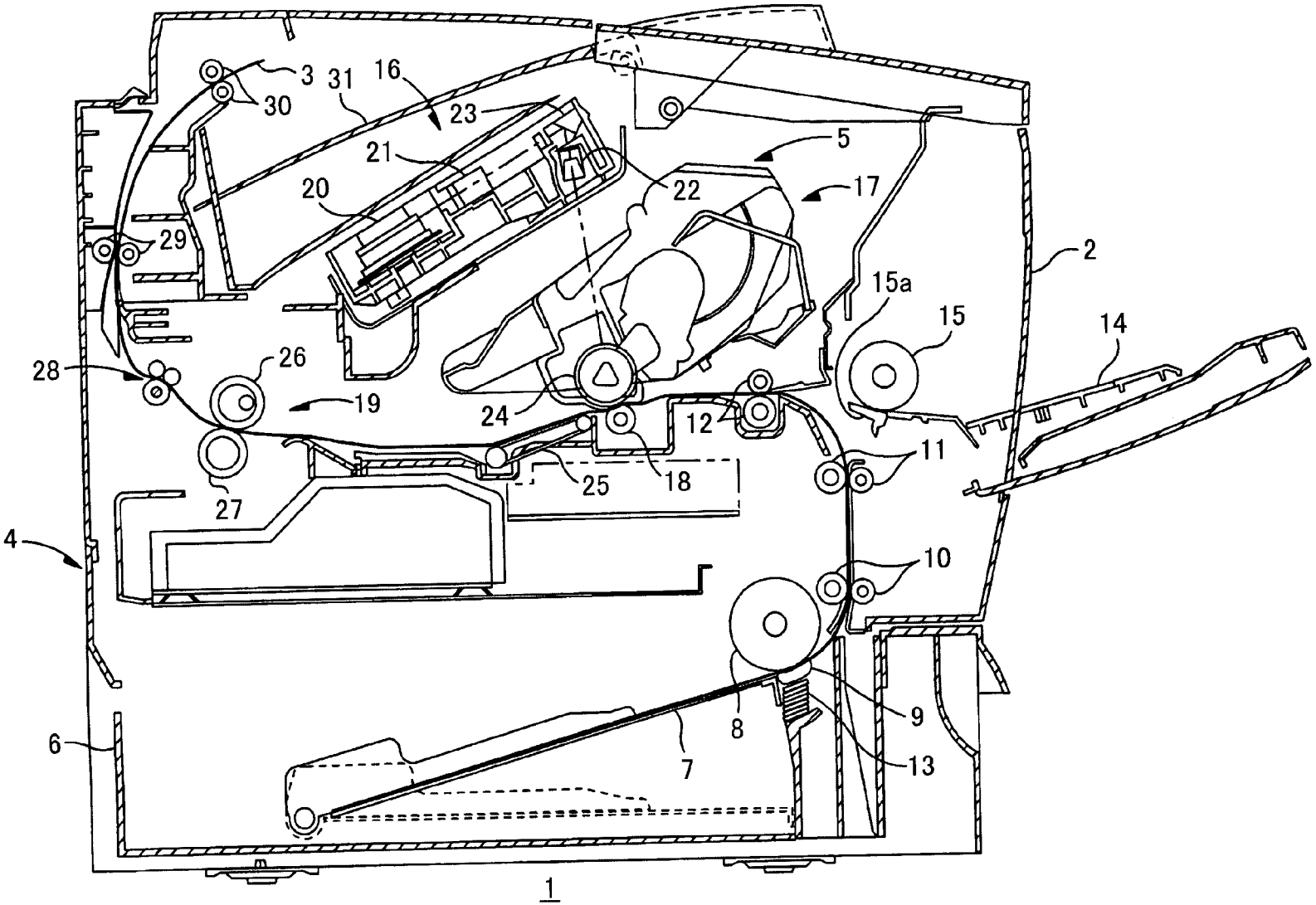
FIG. 1 is a cross-sectional view of a laser printer according to an embodiment of the present invention.

As shown in FIG. 1, the laser printer 1 includes a main casing 2, a feeder unit 4, and an image forming unit 5. The main casing 2 houses the feeder unit 4 and the image forming unit 5. The feeder unit 4 is for feeding paper 3, and the image forming unit 5 is for forming predetermined images on the paper 3.

The feeder unit 4 is disposed in the bottom section of the main casing 2 and includes a feed tray 6, a paper pressing plate 7, a feed roller 8, a separating pad 9, a pair of conveying rollers 10, a pair of conveying rollers 11, and a pair of registration rollers 12. The feed tray 6 is detachably mounted in the feeder unit 4. The paper pressing plate 7 is disposed in the feed tray 6. The feed roller 8 and the separating pad 9 are disposed above one end of the feed tray 6. The conveying rollers 10 and the conveying rollers 11 are provided downstream of the feed roller 8 in a sheet feed direction in which the paper 3 is conveyed (hereinafter upstream or downstream in the sheet feed direction will be abbreviated as simply "upstream" or "downstream"). The registration rollers 12 are disposed downstream of the conveying rollers 10 and 11.

The paper pressing plate 7 is capable of accommodating the paper 3 in a stacked form. The paper pressing plate 7 is pivotally supported at one end farther from the feed roller 8, while another end nearer to the feed roller 8 is movable upward and downward. The another end nearer to the feed roller 8 is urged upwardly by an urging force of a spring (not shown) from the underside. Hence, the paper pressing plate 7 is pivotally moved downward against the urging force of the spring (not shown), as an amount of the paper 3 increases.

The feed roller 8 and the separating pad 9 are disposed confronting each other. A spring 13 is disposed on the underside of the separating pad 9. The spring 13 urges the separating pad 9 against the feed roller 8. The spring (not shown) on the underside of the paper pressing plate 7 presses the topmost paper 3 on the paper pressing plate 7 against the feed roller 8. As the feed roller 8 rotates, the topmost paper 3 becomes interposed between the feed roller 8 and the separating pad 9 and is fed one sheet at a time. The conveying rollers 10 and 11 supply the paper 3 fed by the feed roller 8 to the registration rollers 12. After adjusting the paper 3 to a predetermined registration position, the registration rollers 12 supply the paper 3 to the image forming unit 5.

The pair of registration rollers 12 conveys the paper 3, after registration, to a transfer position at which a photosensitive drum 24 is in contact with a transfer roller 18.

The feeder unit 4 further includes a multipurpose tray 14, a multipurpose feed roller 15, and a multipurpose separating pad 15*a*. The multipurpose feed roller 15 is for feeding paper 3 stacked on the multipurpose tray 14.

The multipurpose feed roller 15 and the multipurpose separating pad 15*a* are disposed confronting each other. The multipurpose separating pad 15*a* is pressed against the multipurpose feed roller 15 by a spring (not shown) provided at the underside of the multipurpose separating pad 15*a*.

As the multipurpose feed roller 15 rotates, the paper 3 stacked on the multipurpose tray 14 becomes interposed between the multipurpose feed roller 15 and the multipurpose separating pad 15*a* and is fed one sheet at a time.

The image forming unit 5 includes a scanning unit 16, a process cartridge 17, a transfer roller 18, and a heat fixing unit 19.

The scanning unit 16 is disposed in the top section of the main casing 2 and includes a laser light-emitting unit (not shown), a polygon mirror 20 that can be driven to rotate, lenses 21 and 22, and a reflecting mirror 23. The laser light-emitting unit (not shown) emits a laser beam according to image data. As shown by the two-dot chain line, the emitted laser beam passes through or reflects at the polygon mirror 20, the lens 21, the reflecting mirror 23, and the lens 22 in this order, and is eventually irradiated on the surface of the photosensitive drum 24 of a process cartridge 17 by a high-speed scanning process.

The process cartridge 17 is disposed below the scanning unit 16 and is detachably mounted in the main casing 2. The process cartridge 17 includes the photosensitive drum 24, as well as a Scorotron charger, a, developing roller, a supply roller, a toner accommodating unit, and the like (all of which are not shown in the drawings).

The toner accommodating unit is filled with non-magnetic, single-component toner with a positive charging nature serving as a developer. The toner is a polymeric toner obtained by copolymerizing polymeric monomers using a well-known polymerization method such as suspension polymerization. Examples of polymeric monomers include styrene monomers and acrylic monomers. Styrene is an example of a styrene monomer. Examples of acrylic monomers include acrylic acid, alkyl (C1 to C4) acrylate, and alkyl (C1 to C4) methacrylate. Such polymer has a spherical shape and has excellent fluidity. Hence, high quality images can be formed by using the polymeric toner.

A coloring agent, such as carbon black, and wax are mixed in the polymeric toner. An externally added agent such as silica is also added in order to improve fluidity. Particle diameter of the polymeric toner is approximately 6 to 10 μm.

The toner is carried on the developing roller in a predetermined thin thickness. The photosensitive drum 24 is rotatably disposed in confrontation with the developing roller. The photosensitive drum 24 is formed of a drum body that is grounded. The surface of the photosensitive drum 24 is formed of a positively-charging photosensitive layer of polycarbonate or the like.

As the photosensitive drum 24 rotates, the Scorotron charger applies a uniform positive charge across the entire surface of the photosensitive drum 24. Subsequently, the surface of the photosensitive drum 24 is exposed to high-speed scanning of a laser beam emitted from the scanning unit 16, forming electrostatic latent images on the surface based on predetermined image data. When the photosensitive drum 24 opposes the developing roller, the positively charged toner carried on the surface of the developing roller is selectively supplied to the electrostatic latent image on the photosensitive drum 24, i.e., to areas of the surface of the uniformly charged photosensitive drum 24 that were exposed to the laser beam and, therefore, have a lower potential than the rest of the surface. As a result, the electrostatic latent images on the photosensitive drum 24 are transformed into visible toner images. In this way, the toner images are formed.

The transfer roller 18 is rotatably supported on the main casing 2 at a position below and in opposition to the photosensitive drum 24. The transfer roller 18 includes a metal roller shaft covered by a roller that is formed of an electrically conductive rubber material. A predetermined transfer bias with respect to the photosensitive drum 24 is applied to the transfer roller 18. Accordingly, the visible toner image on the photosensitive drum 24 is transferred to the paper 3, as the paper 3 passes between the photosensitive drum 24 and the transfer roller 18. After the visible toner image is transferred in this way, the paper 3 is conveyed to the heat fixing unit 19 by a conveying belt 25.

The heat fixing unit 19 is disposed downstream of the process cartridge 17 and includes a heat roller 26, a pressure roller 27, and a conveying roller 28. The pressure roller 27 is disposed opposing the heat roller 26 with the paper 3 interposed therebetween and is pressed against the heat roller 26.

The conveying roller 28 is disposed downstream of the heat roller 26 and the pressure roller 27.

In the heat fixing unit 19, the heat roller 26 and the pressure roller 27 rotate to pinch and convey the paper 3 which has been transferred from the conveying belt 25. As the paper 3 passes between the heat roller 26 and the pressure roller 27, the toner image is fixed onto the paper 3.

After being fixed in the heat fixing unit 19, the paper 3 is conveyed to a pair of discharge rollers 30 by pairs of conveying rollers 28 and 29 disposed downstream of the heat fixing unit 19. The discharge rollers 30 subsequently discharge the paper 3 onto a discharge tray 31.

Next, the heat fixing device 19 will be described in greater detail while referring to FIGS. 2 through 7.

Figure 2:
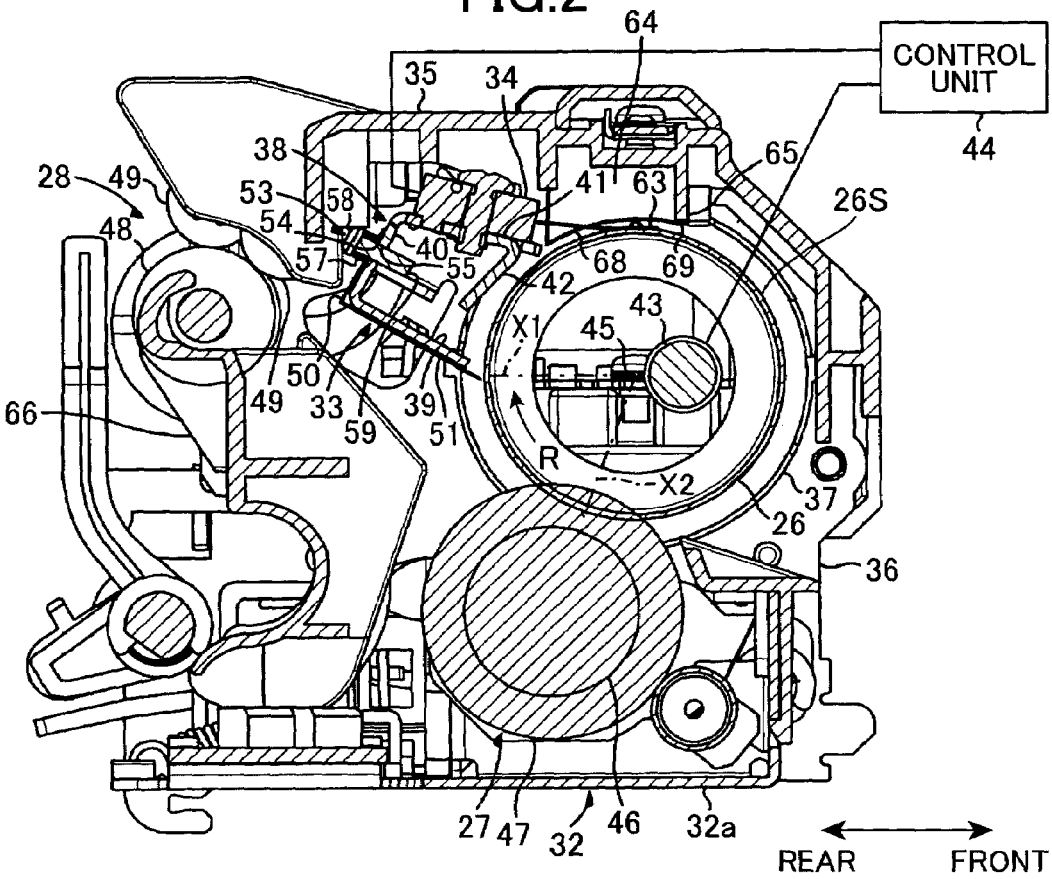
FIG. 2 is a cross-sectional view of a heat fixing device in the laser printer of FIG. 1.
Figure 4:
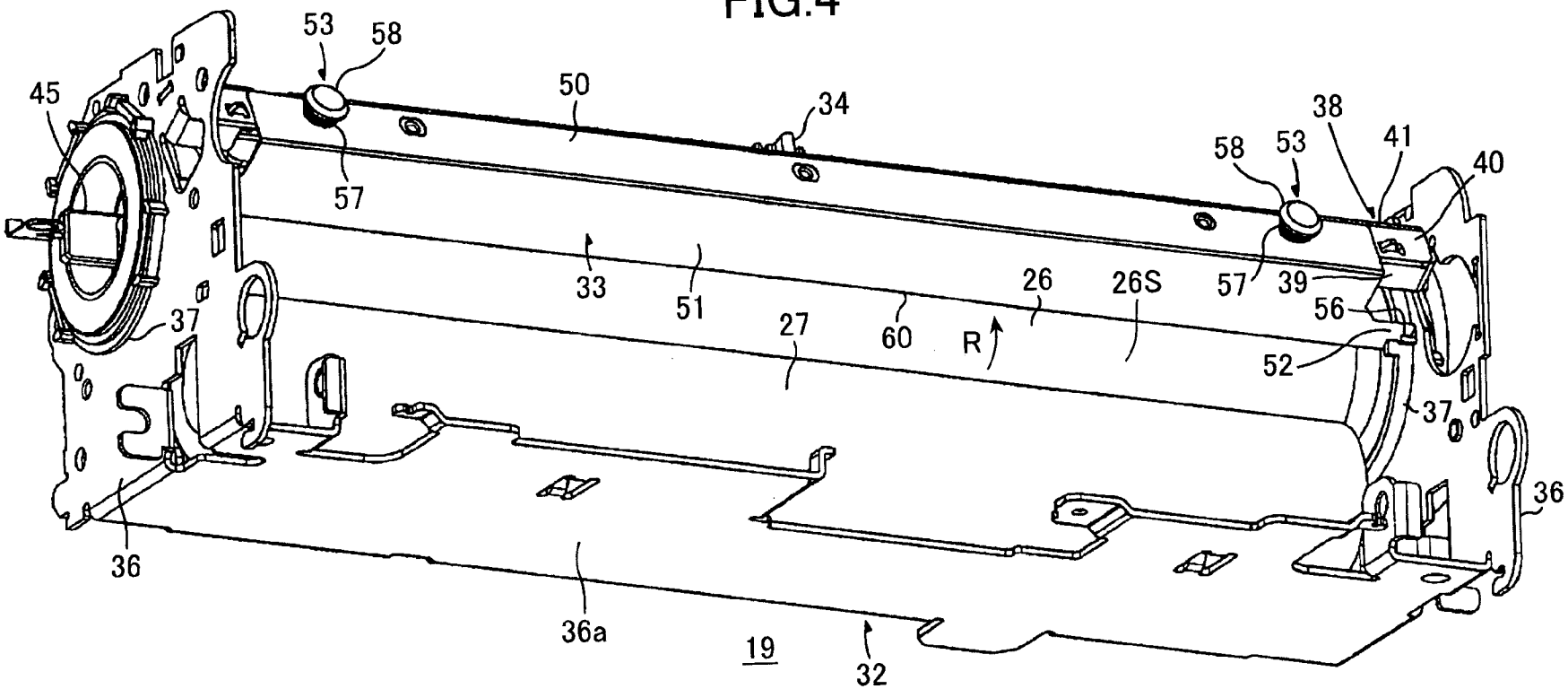
FIG. 4 is a perspective view as viewed from an oblique left side of the heat fixing device of FIG. 2.

As shown in FIGS. 2 and 4, the heat fixing device 19 includes the heat roller 26, the pressure roller 27, and the feed roller 28 described previously, as well as a frame 32, a separation plate 33, a thermistor 34, and a cover member 35. The frame 32 is for supporting the heat roller 26, the pressure roller 27, and the feed roller 28. The separation plate 33 is for separating the paper 3 from the heat roller 26. The thermistor 34 is for detecting the temperature of the heating surface 26S of the heat roller 26.

Figure 5A:
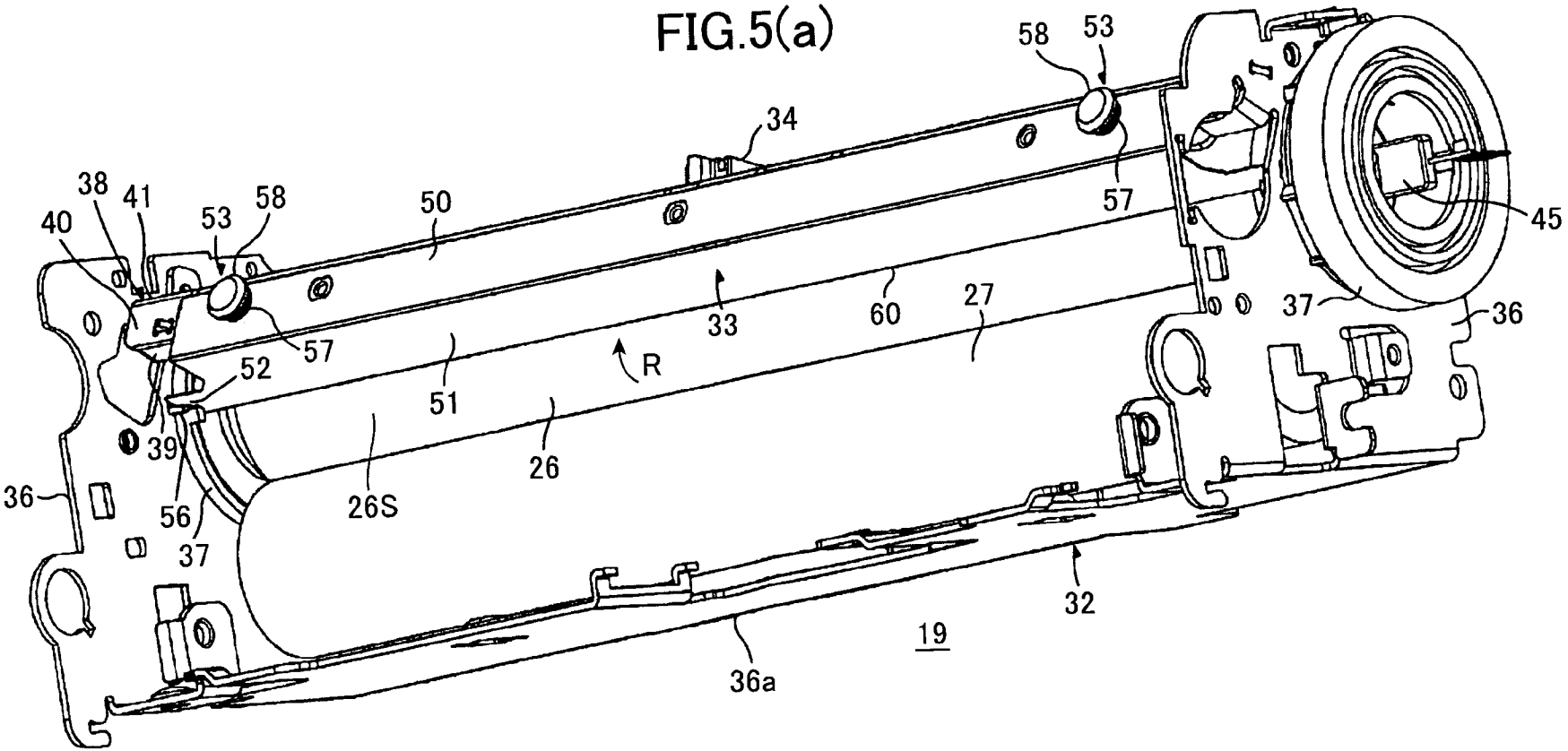
FIG. 5(*a*) is a perspective view as viewed from an oblique right side of the heat fixing device of FIG. 2.
Figure 5B:
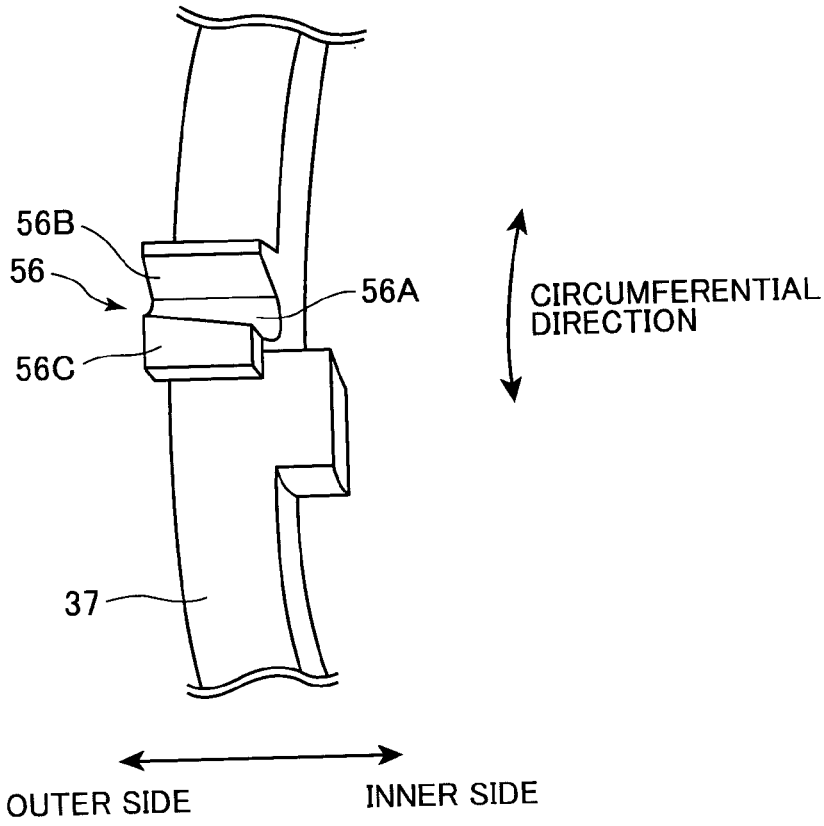
Figure 5C:
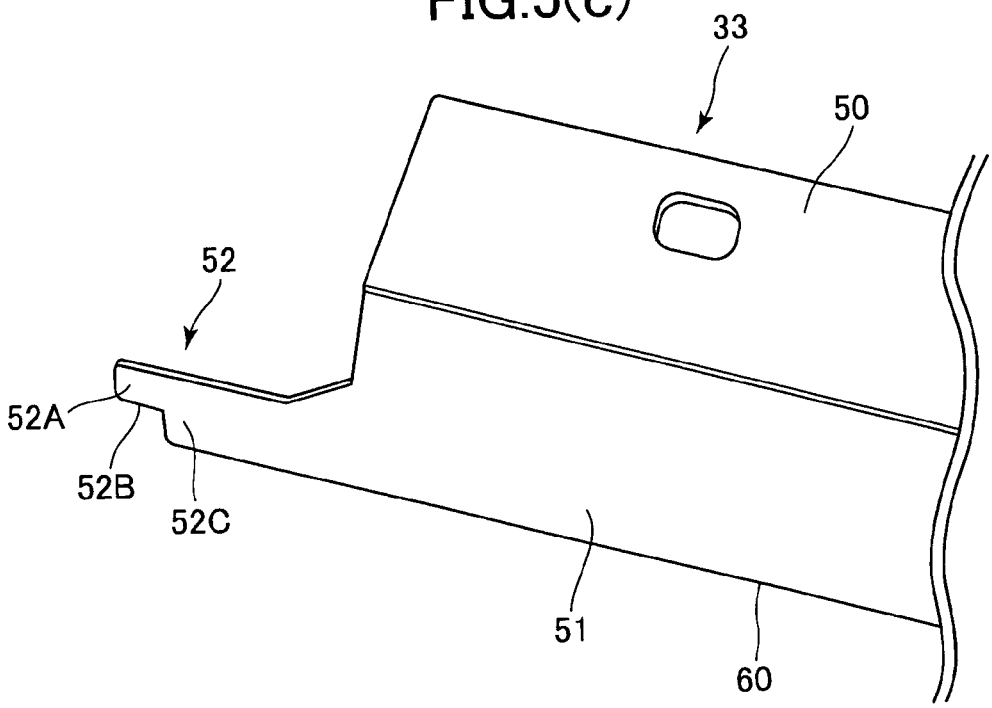

As shown in FIGS. 4, and 5, the frame 32 includes a pair of side plates 36 that confronts each other on either side of the heat roller 26 in the axial direction thereof, a base plate 36*a* connecting the side plates 36, and a connecting pole 38 that serves as a holder member for connecting the side plates 36.

A bearing member 37 is embedded in each of the side plates 36 for rotatably supporting the heat roller 26.

Each bearing member 37 is formed in an annular shape having an inner diameter corresponding to the outer diameter of the heat roller 26, such that the outer peripheral surface 26S of the heat roller 26 is rotatably borne thereby. As shown in FIGS. 5(*a*) and 5(*b*), each bearing member 37 is provided with a receiving portion 56 that can receive and support a positioning portion 52 of the separation plate 33, as will be described later. Both receiving portions 56 are positioned confronting each other with the heat roller 26 therebetween in the axial direction. As shown in FIG. 5(*b*), each receiving portion 56 includes a cutout 56A, a protruding portion 56B, and a protruding portion 56C. The cutout 56A is formed between the protruding portions 56B and 56C. The cutout 56A is a substantially V-shaped groove or concave portion that narrows gradually toward the outer side from the inner side thereof in the axial direction.

The base plate 36*a* is disposed along the axial direction of the heat roller 26 and is connected to lower edge portions of the two side plates 36.

Figure 3:
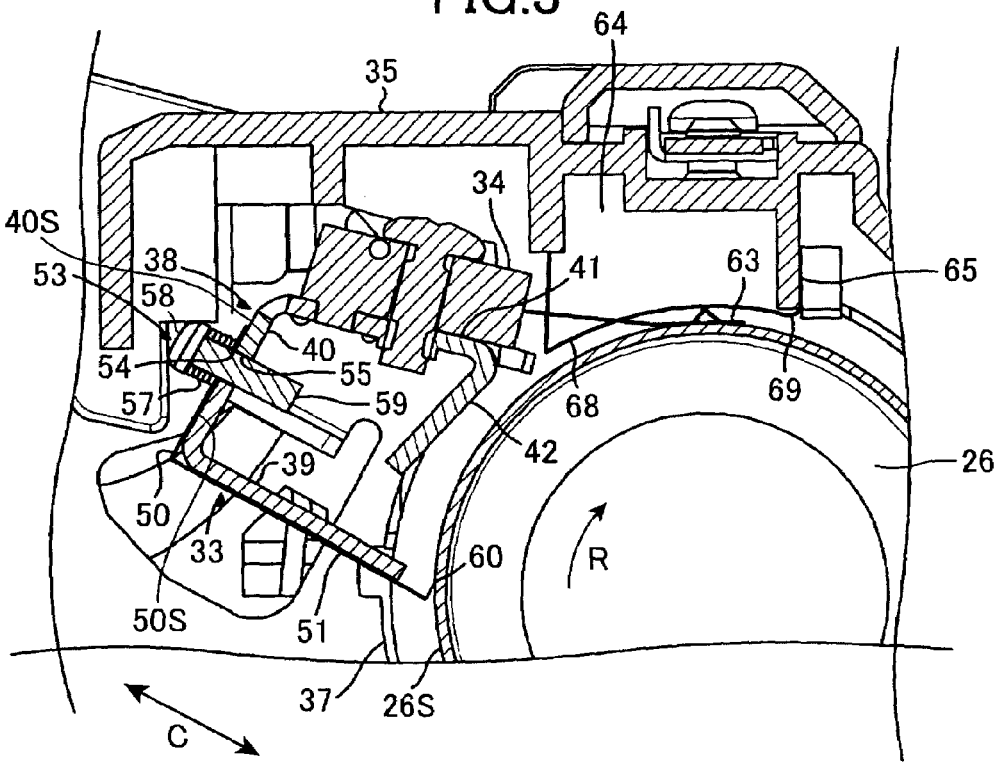
FIG. 3 is an enlarged cross-sectional view of the heat fixing device of FIG. 2.

As shown in FIGS. 2 and 3, the connecting pole 38 includes a lower plate 39, a central plate 40, an upper plate 41, and a guide plate 42. The central plate 40 serves as a reinforcing member and is bent at a substantially right angle to the lower plate 39. The upper plate 41 is bent at a substantially right angle to the central plate 40. The guide plate 42 serves as a guide member and is bent at a substantially acute angle to the upper plate 41. In other words, a longitudinal side (a side extenging in the longitudinal direction) of the lower plate 39 is connected to one longitudinal side the central plate 40 at a substantially right angle. Similarly, a longitudinal side of the upper plate 41 is connected to the other longitudinal side of the central plate 40 at a substantially right angle. Thus, the connecting pole 38 has a substantially rectangular U-shape with the lower plate 39 and the upper plate 41 confronting each other over the central plate 40, and also has the guide plate 42 that is folded into a substantially V-shape from the upper plate 41.

The connecting pole 38 is disposed downstream in the rotational direction R of the heat roller 26 from a contact position at which the heat roller 26 and the pressure roller 27 are in contact. The connecting pole 38 connects the side plates 36 such that its longitudinal direction is parallel to the axial direction of the heat roller 26. An open portion between the lower plate 39 and the upper plate 41 confronts the heat roller 26. In other words, the central plate 40 confronts the heat roller 26 and is separated therefrom by the lower plate 39 and the upper plate 41.

More specifically, as shown in FIG. 2, the connecting pole 38 is disposed such that a line segment X1 and a line segment X2 forms an angle of 45° to 90°. The line segment X1 links a free edge portion 60 of a separating portion 51 (FIG. 7) supported on the lower plate 39 to a rotational center of the heat roller 26. The line segment X2 links the contact position at which the heat roller 26 and the pressure roller 27 are in contact to the rotational center of the heat roller 26.

The above-described configuration ensures that the guide plate 42 is disposed at a predetermined space from the surface 26S of the heat roller 26 such that the guide plate 42 extends substantially along the rotational direction R of the heat roller 26. Therefore, the guide plate 42 can guide the paper 3 along the surface 26S on the upstream side of the thermistor 34 in the rotational direction R of the heat roller 26.

Screw holes 55 are formed in both end portions of the central plate 40 in its longitudinal direction (the axial direction). Screws 53 are inserted into the screw holes 55 (FIGS. 4 and 5).

The heat roller 26 is formed in a circular cylindrical shape by pultruding a metal such as aluminum. The both end portions of the heat roller 26 in the axial direction are pressed into the bearing members 37. Accordingly, the heat roller 26 is driven to rotate by an input of a driving force from a motor (not shown).

A heater 43 is provided within the heat roller 26. The heater 43 is a halogen heater or the like that is heated by electricity. The heater 43 extends in the axial direction of the heat roller 26 at an offset disposition within the heat roller 26, for heating the heat roller 26 The heater 43 is connected to a control unit 44 that includes a CPU or the like, whereby the control unit 44 controls driving and halting of the heater 43. Thus, the surface 26S of the heat roller 26 is maintained at the fixing temperature that has been set. The heater 43 is connected to wiring 45 through which electrical power from a power source (not shown) passes.

The pressure roller 27 is pressed against the heat roller 26 from beneath the heat roller 26. The pressure roller 27 is formed of a metal roller shaft 46 covered with a roller 47 formed of a rubber material having heat resistance. Axial end portions of the roller shaft 46 are rotatably supported in the side plates 36. The pressure roller 27 is rotated following the rotational drive of the heat roller 26 when the heat roller 26 is driven to rotate.

The feed roller 28 is disposed on the downstream side of the heat roller 26 and the pressure roller 27 in a direction in which the paper 3 is conveyed. The feed roller 28 includes a drive roller 48 disposed on the lower side of the conveying path of the paper 3 and two pinch rollers 49 disposed in a front-to-rear direction on the upper side thereof.

The drive roller 48 is rotatably supported by a holder member 66. The holder member 66 is a separate member from the frame 32. The drive roller 48 is driven to rotate by an input of a driving force from a motor (not shown).

Figure 6:
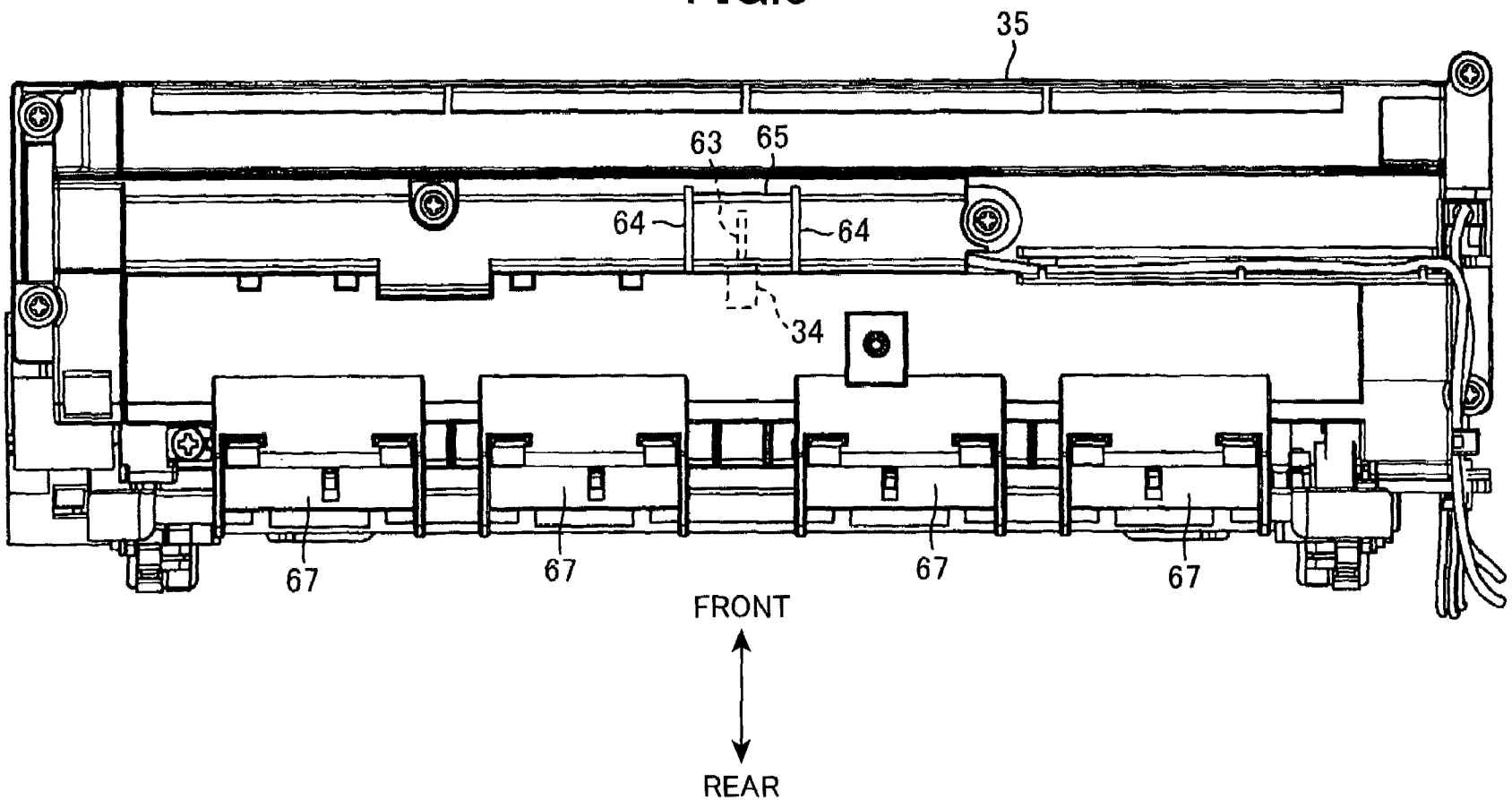
FIG. 6 is a bottom view as viewed from underneath a cover member of the heat fixing device of FIG. 2.

As shown in FIG. 6, the pinch rollers 49 are rotatably supported in pinch roller support portions 67 that are provided on a rear edge portion of the cover member 35. The pinch rollers 49 are rotated following the rotation of the drive roller 48.

The separation plate 33 is formed by cutting by a pressing process or stamping process from a thin-film plate of a material such as stainless steel having a thickness T (FIG. 7) of 0.2 to 0.5 mm. As shown in FIGS. 4 and 5, the separation plate 33 extends parallel to the axial direction of the heat roller 26. The separation plate 33 has an integral structure provided with a fixed portion 50, the separating portion 51, and the positioning portions 52, with the fixed portion 50 and the separating portion 51 substantially forming an L-shape in section. The fixed portion 50 confronts and contacts the central plate 40. The separating portion 51 is bent at a substantially right angle from the fixed portion 50 and confronts the lower plate 39. The positioning portions 52 are provided at the both end portions of the separating portion 51.

Through-holes 54 for the screws 53 are formed in the fixed portion 50 at positions corresponding to the screw-holes 55 of the central plate 40 at end portions in the longitudinal direction.

As shown in FIGS. 4 and 5, the positioning portions 52 have a substantially rectangular plate shape. The positioning portions 52 protrude outwardly in the axial direction of the heat roller 26 from the both end portions of free edge portion 60 of the separating portion 51. More specifically, as shown in FIG. 5(*c*), each positioning portion 52 includes an end portion 52A and a body portion 52C. The end portion 52A has a substantially rectangular plate shape and has a positioning edge 52B that comes into contact with the cutout 56A of the receiving portion 56. The body portion 52C also has a substantially rectangular plate shape and is continuously connected to the separating portion 51.

The separation plate. 33 is attached to the connecting pole 38 as described below. As shown in FIGS. 2 and 3, first the fixed portion 50 is placed with respect to the central plate 40 so that the through-holes 54 align with the screw-holes 55, and the separating portion 51 is placed with respect to the lower plate 39 such that the positioning portions 52 come into contact with the corresponding receiving portions 56. Subsequently, a coil spring 57 is disposed surrounding each through-hole 54. A screw 53 has a head portion 58 having a diameter larger than a diameter of the coil spring 57, and a screw shaft 59. The screw shaft 59 is inserted in the corresponding coil spring 57 and the through-hole 54, and is screwed into the screw-hole 55. In this way, the coil spring 57 is sandwiched between a periphery of the through-hole 54 in the fixed portion 50 and the head portion 58 of the screw 53, urging the fixed portion 50 and the head portion 58 in a direction away from each other. The separation plate 33 is positioned and fixed with respect to the connecting pole 38 with the screws 53 therebetween, in a state in which the positioning portions 52 are in pressure contact with the cutouts 56A of the bearing members 37.

At this time, as shown in FIGS. 5(*a*) through 5(*c*), the positioning edge 52B of the positioning portion 52 are in pressure contact with the cutout 56A of the receiving portion 56. Because of the contact between the positioning edge 52B and the cutout 56A, the space L between the free edge portion 60 of the separating portion 51 and the surface 26S of the heat roller 26 can be maintained with a strict dimensional accuracy. In addition, the protruding portions 56B and 56C prevent the positioning portion 52 from shifting in a circumferential direction of the bearing member 37. Thus, even more accurate positioning of the separating portion 51 can be achieved.

In the above-described fixed state, the separation plate 33 is positioned downstream from the contact position between the heat roller 26 and the pressure roller 27 in the rotational direction R of the heat roller 26. The separation plate 33 is also positioned upstream from the thermistor 34.

Figure 7A:
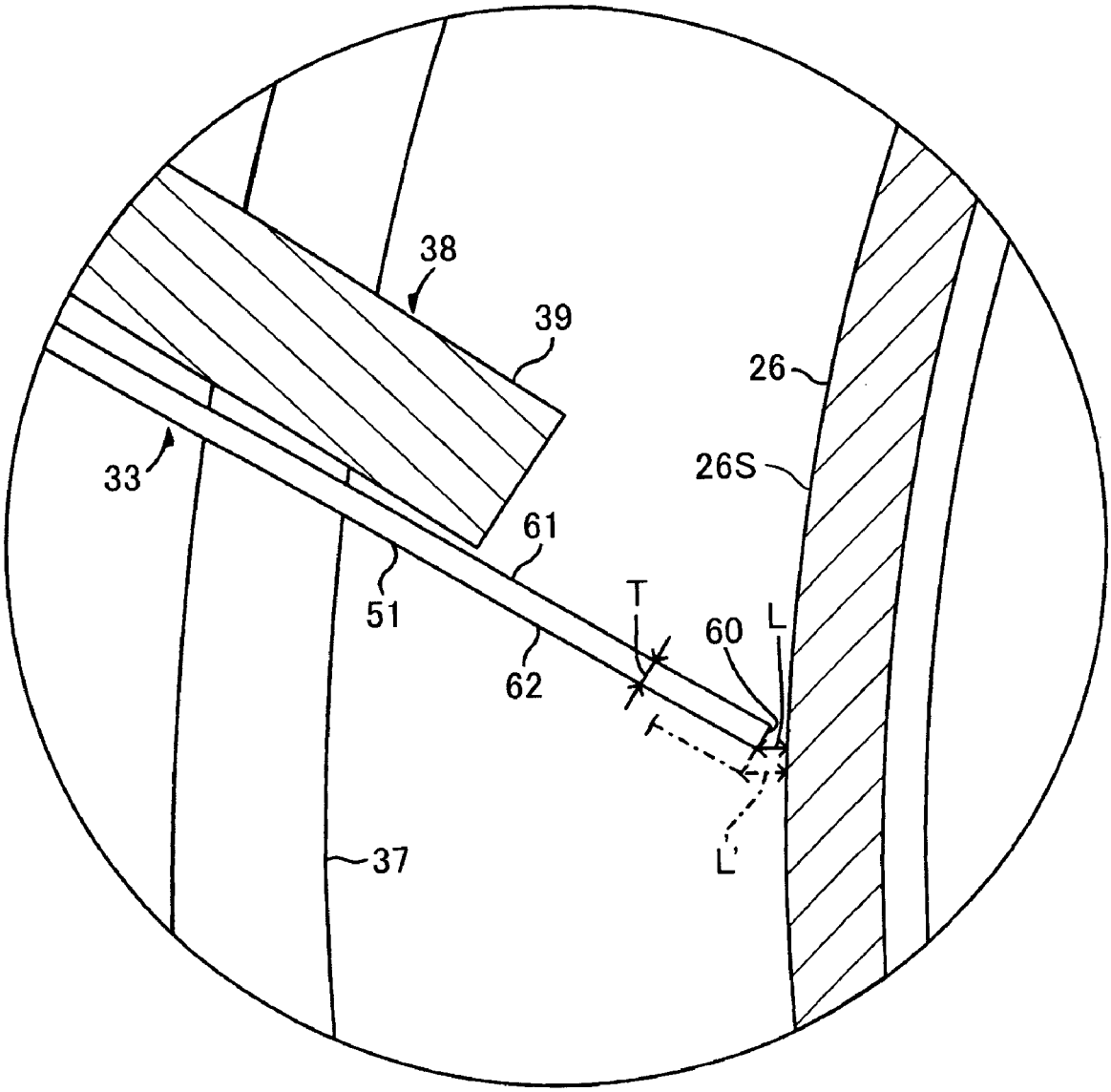
FIG. 7(*a*) is an enlarged cross-sectional view showing relationships between a separating portion and a heat roller.
Figure 7B:
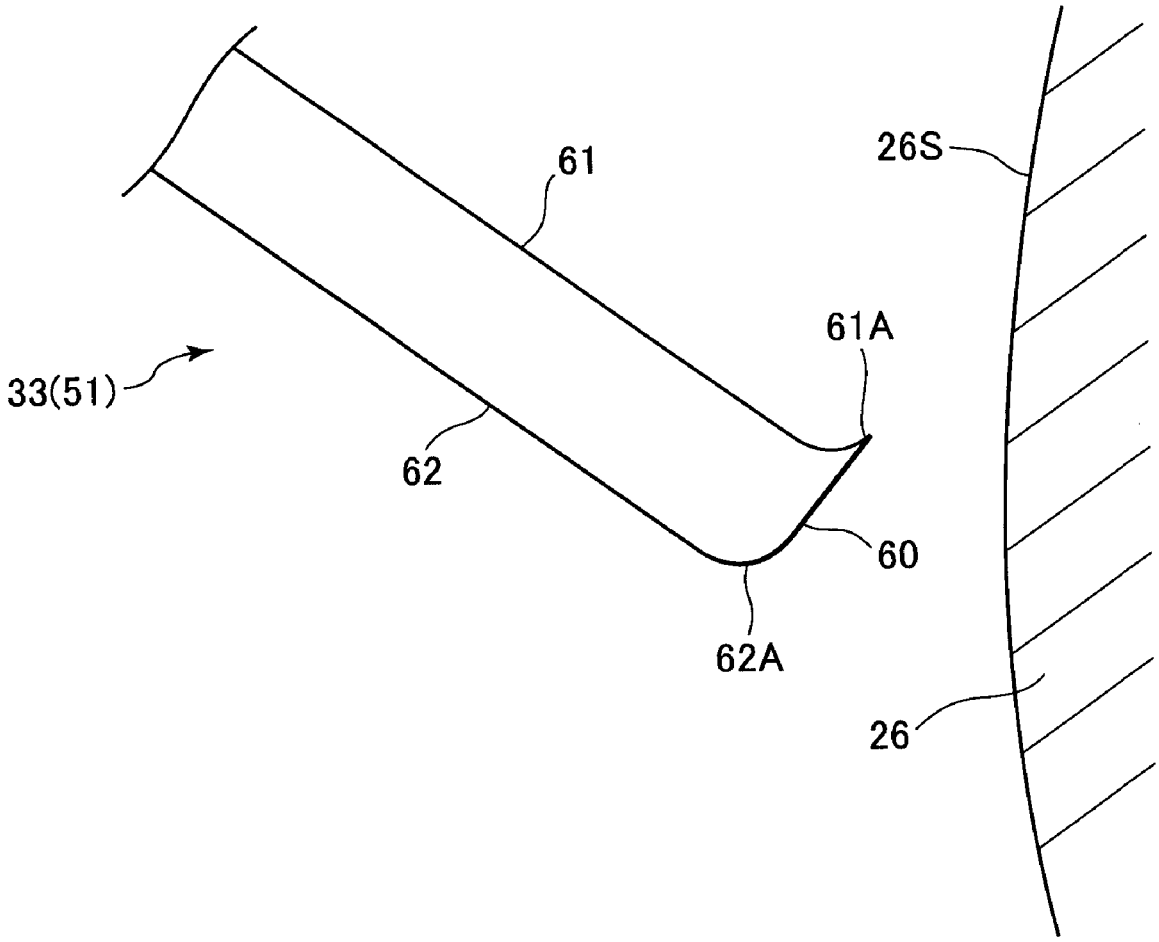

As shown in FIG. 7, the free edge portion 60 of the separating portion 51 confronts the surface 26S of the heat roller 26 at a space L therefrom that is less than or equal to 0.6 mm ($0<L\leqq 0.6$ mm), and preferably 0.2 to 0.6 mm ($0.2\leqq L\leqq 0.6$ mm). As described above, the space L is maintained by the positioning portions 52.

In the thus-located state, the central plate 40 reinforces the separation plate 33 by supporting the fixed portion 50 in a direction in which the fixed portion 50 confronts the surface 26S of the heat roller 26.

As shown in FIG. 3, the separation plate 33 confronts the heat roller 26 in a confrontation direction C. In other words, the separation plate 33 and the heat roller 26 are arranged in the confrontation direction C. The central plate 40 of the connecting pole 38 supports the fixed portion 50 of the separation plate 33 in the confrontation direction C, thereby reinforcing the separation plate 33.

More specifically, the central plate 40 has a surface 40S that confronts the fixed portion 50 and extends substantially perpendicular to the confrontation direction C. Similarly, the fixed portion 50 has a surface 50S that confronts the central plate 40 and extends substantially perpendicular to the confrontation direction C. The surface 50S and the surface 40S are in pressure contact with each other by an urging force of the coil spring 57. That is, the surface 50S and the surface 40S are fixed with each other by the urging force of the coil spring 57.

The separation plate 33 is formed by cutting by a pressing process or a stamping process. As shown in FIG. 7(*b*), when a metal plate has been cut by a pressing process, a surface 62 that comes into contact with a cutting blade first (shear-drooped side) has a rounded corner 62A. In contrast, a surface 61 opposite to the surface 62 has an edge 61A. As shown in FIGS. 7(*a*) and 7(*b*), when the surface 62 that comes into contact with the cutting blade first is called a front surface 62 and the surface 61 opposite to the front surface 62 is called a back surface 61, the separation plate 33 is disposed such that the back surface 61 confronts the surface 26S of the heat roller 26.

The front surface 62 and the back surface 61 of the separation plate 33 has a fluoride coating formed of polytetrafluoroethylene or the like, as adhesion prevention process for preventing the toner from adhering to the front surface 62 and the back surface 61 of the separation plate 33.

As shown in FIGS. 2 and 3, the thermistor 34 is a contact-type temperature sensor that has a temperature detecting portion 63 which is an elastic flat plate.

The thermistor 34 is installed in a central portion along the lengthwise direction of the upper plate 41 of the connecting pole 38, such that the temperature detecting portion 63 is in contact with the surface 26S of the heat roller 26.

The thermistor 34 is connected to the control unit 44. The thermistor 34 detects the temperature of the surface 265 of the heat roller 26 and inputs a corresponding detecting signal to the control unit 44. The control unit 44 controls driving and halting of the heater 43, based on the detecting signal from the thermistor 34, thereby maintaining the temperature of the surface 26S at a set fixing temperature.

As shown in FIG. 2, the cover member 35 is formed of a plastic and is fixed to the main casing 2 so as to cover an upper part of the frame 32.

As shown in FIG. 6, side guide members 64 and a regulating guide member 65 are integrally formed with the plastic cover member 35. In other words, the side guide members 64 and the regulating guide member 65 are disposed at the plastic cover member 35. The side guide members 64 guide, along the surface 26S of the heat roller 26, the paper 3 that has been conveyed into the vicinity of the thermistor 34 without being separated from the heat roller 26 by the separating portion 51. When the paper 3 has jammed at a position downstream of the thermistor 34 in the rotational direction R of the heat roller 26 (a situation shown in FIG. 9(*b*)), the regulating guide member 65 prevents the jammed paper 3 from being conveyed to the upstream side and damaging the thermistor 34 and the temperature detecting portion 63.

As shown in FIGS. 2, 3, and 6, the side guide members 64 have plate shape that extend downward from the cover member 35. The side guide members 64 are disposed, along the rotational direction R of the heat roller 26, on both sides of the temperature detecting portion 63 of the thermistor 34 in the axial direction of the heat roller 26. As shown in FIG. 6, the side guide members 64 are spaced away from the temperature detecting portion 63 in the axial direction of the heat roller 26. As shown in FIGS. 2 and 3, a lower edge portion 68 of each side guide member 64 is formed as a curve along the surface 26S of the heat roller 26 in the rotational direction R thereof. The side guide members 64 are positioned in the vicinity of the surface 26S of the heat roller 26 at a predetermined space therefrom that is less than or equal to 1.5 mm.

The regulating guide member 65 is provided connecting the side guide members 64 and extending in a direction perpendicular to a direction in which the side guide members 64 extend, on the downstream side from the temperature detecting portion 63 in the rotational direction R of the heat roller 26. A lower edge portion 69 of the regulating guide member 65 is formed parallel to the surface 268 of the heat roller 26. The lower edge portion 69 is positioned in the vicinity of the surface 26S of the heat roller 26 at a space that is less than or equal to 1.5 mm therefrom.

With the heat fixing device 19 as described above, a toner image is fixed onto the paper 3 between the heat roller 26 and the pressure roller 27, while the paper 3 is being sandwiched or pinched between and transported by the heat roller 26 and the pressure roller 27. Since this configuration enables the fixing of the toner image onto the paper 3 while the paper 3 is being transported between the heat roller 26 and the pressure roller 27, efficient fixing can be performed.

Figure 8A:
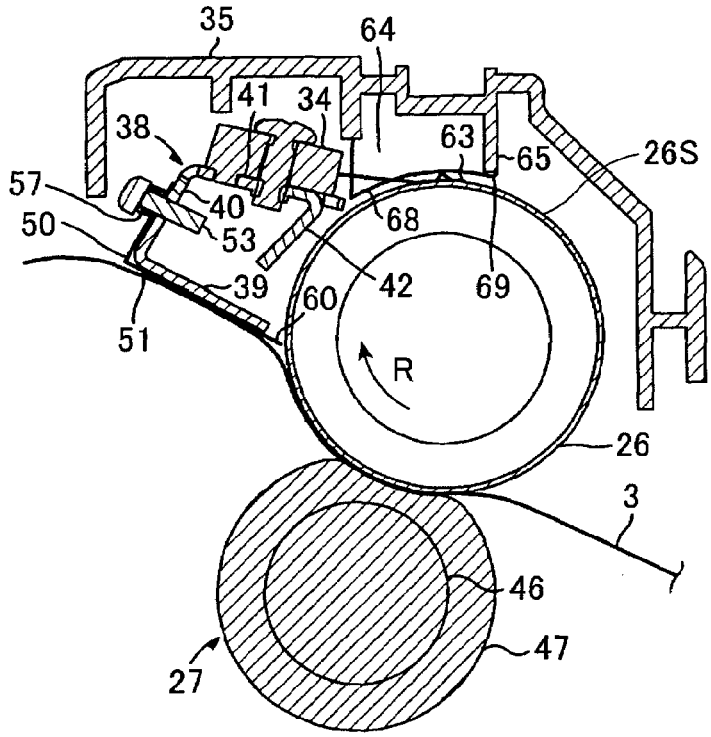
FIG. 8(*a*) is an explanatory diagram showing a state in which the paper is being separated by a separation plate in the heat fixing device of FIG. 2.
Figure 8B:
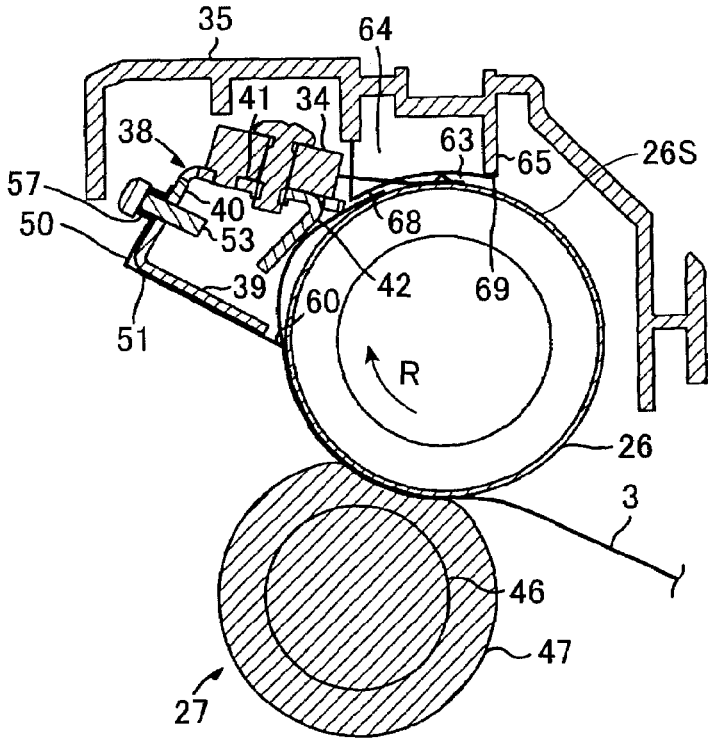

As shown in FIG. 8(*a*), a leading edge of the paper 3 on which the toner image has been fixed comes into contact with the free edge portion 60 of the separating portion 51 and is separated from the heat roller 26.

Since the free edge portion 60 of the separating portion 51 confronts the surface 26S of the heat roller 26 at a space L satisfying an inequality $0<L\leqq 0.6$ mm, the paper 3 can be separated reliably from the surface 26S while the free edge portion 60 of the separating portion 51 is held separated from the surface 26S. Thus, the paper 3 can be separated from the surface 26S by the separating portion 51, while preventing damage due to contact between the edge portion 60 and the surface 26S, as well as the occurrence of abnormal noises.

Moreover, since the positioning portions 52 of the separation plate 33 are wedged into each cutout 56A and maintain the space L between the free edge portion 60 of the separating portion 51 and the surface 26S of the heat roller 26, the space L can be maintained with a strict dimensional accuracy. Above all, the separation plate 33 is fixed to the connecting pole 38 by the screws 53 in a state in which the positioning portions 52 are in pressure contact with the receiving portions 56 of the bearing members 37 by the coil springs 57. Thus, the separation plate 33 can be positioned with respect to the connecting pole 38 while the space L between the free edge portion 60 and the surface 26S is maintained at a stricter dimensional accuracy. Because of wedging of the positioning portions 52 into the cutouts 56A, it is unnecessary to provide the separation plate 33 with means for coping with high temperatures and means for positioning movable components accurately.

Moreover, since the separation plate 33 is formed as a film plate with a thickness T of 0.2 to 0.5 ma, the space L between the free edge portion 60 of the separating portion 51 and the surface 26S of the heat roller 26 can be made smaller. In other words, as shown by a broken line in FIG. 7, if the thickness T of the separation plate 33 were too great, it would be impossible to make a space L' between the free edge portion 60 and the surface 26S small enough, even if the free edge portion 60 were brought into the vicinity of the surface 26S. In this case, it would not be possible to separate the paper 3 from the surface 26S of the heat roller 26 in a favorable manner. However, since the separation plate 33 is made of a thin-plate as described above, the space L between the free edge portion 60 and the surface 26S can be reduced and thus the paper 3 can be separated reliably from the surface 26S of the heat roller 26.

Since the fixed portion 50 is reinforced by the central plate 40 of the connecting pole 38 in the direction toward the surface 26S of the heat roller 26 by supporting the fixed portion 50 in the direction toward the surface 26S of the heat roller 26, more reliable support of the separation plate 33 can be achieved.

Since the separation plate 33 is supported on the connecting pole 38 such that the front surface 62 is a shear-drooped side formed by the pressing process and has the rounded corner 62A, the paper 3 does not catch on the free edge portion 60 when the paper 3 comes into contact with the free edge portion 60 of the separating portion 51. Thus, smooth separation of the paper 3 can be achieved.

Furthermore, the front surface 62 and the back surface 61 of the separation plate 33 has a fluoride coating process. Accordingly, the adhesion of toner from the paper 3 can be prevented, even when the paper 3 comes into contact with the separation plate 33, thereby preventing toner on the separation plate 33 from adhering to the next sheet of paper 3.

As shown in FIG. 8(*b*), the guide plate 42 of the connecting pole 38 is disposed at a predetermined space from the surface 26S of the heat roller 26 between the separation plate 33 and the thermistor 34 in the rotational direction R, such that the guide plate 42 extends along the rotational direction R of the heat roller 26. Accordingly, even if the paper 3 on which the toner image has been fixed is not separated from the heat roller 26 by the separation plate 33 and is conveyed onward so as to pass between the free edge portion 60 and the surface 26S in the heat fixing device 19, the guide plate 42 can guide the paper 3 along the surface 26S of the heat roller 26. In other words, when the paper 3 passes between, the free edge portion 60 and the surface 26S and is further conveyed to the temperature detecting portion 63, the paper 3 contacts the temperature detecting portion 63. However, because the side guide members 64 guide a conveying direction of the paper 3, the paper 3 is conveyed smoothly along the surface 26S and does not damage the temperature detecting portion 63. In addition, an occurrence of jamming can be prevented.

Figure 9A:
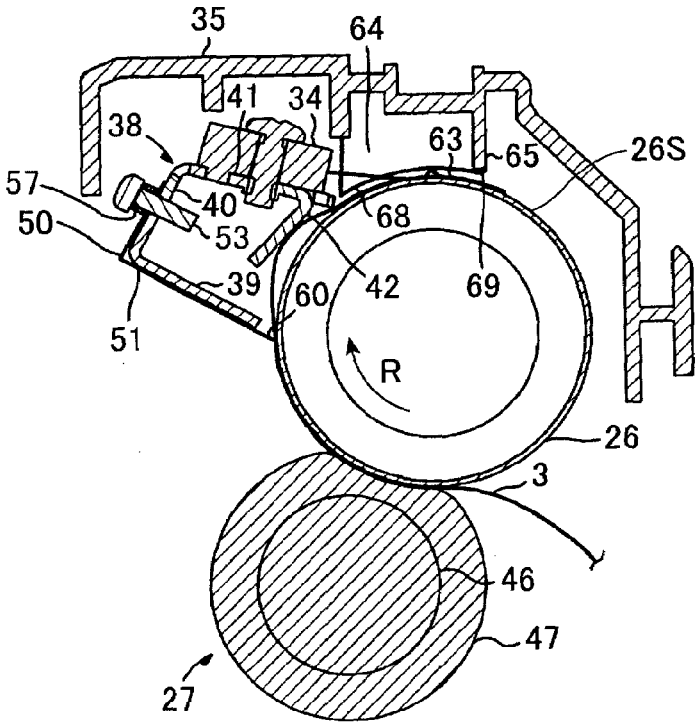
FIG. 9(*a*) is an explanatory diagram showing a state in which paper is guided by side guide members on both sides of a thermistor in the heat fixing device of FIG. 2.
Figure 9B:
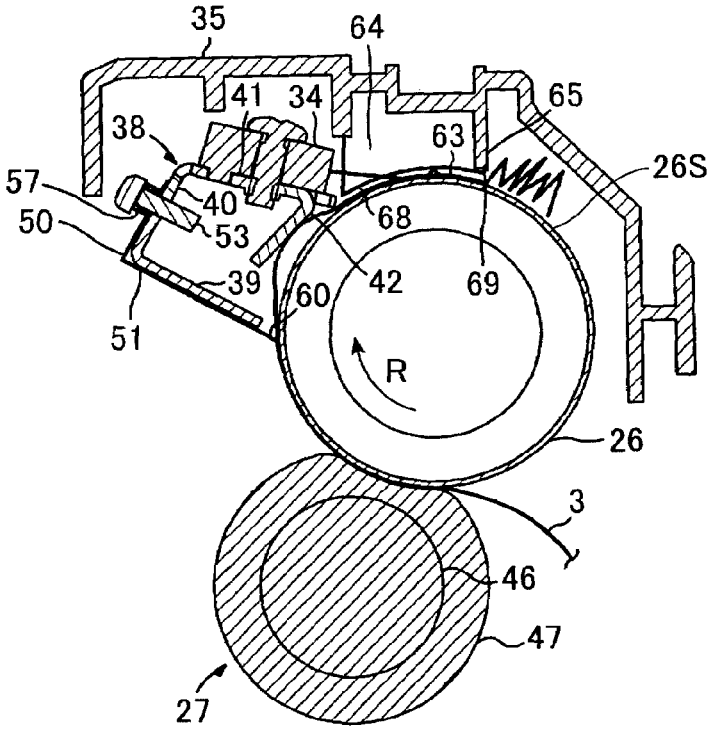

As shown in FIG. 9(*a*), the heat fixing device 19 includes the two side guide members 64 extending along the rotational direction R of the heat roller 26. The side guide members 64 are positioned on both sides of the temperature detecting portion 63 and spaced away from the temperature detecting portion 63 in the axial direction of the heat roller 26. Accordingly, the side guide members 64 can guide, along the surface 26S of the heat roller 26, the paper 3 that has not been separated from the heat roller 26 by the separation plate 33 and has been conveyed into the vicinity of the thermistor 34. Therefore, the heat fixing device 19 can convey the paper 3 smoothly from the upstream side of the thermistor 34 in the rotational direction R to the downstream side thereof. That is, the heat fixing device 19 enables reliable guiding of the paper 3 between the upstream side and the downstream side of the thermistor 34 and thus reliably prevents damage of the thermistor 34 due to a contact with the jammed paper 3.

The lower edge portion 68 of each side guide member 64 is formed as a curve along the surface 26S in the rotational direction R of the heat roller 26 and is disposed at a space from the surface 26S that is less than or equal to 1.5 mm. Accordingly, the paper 3 can be guided reliably along the surface 26S of the heat roller 26.

In addition, the regulating guide member 65 is provided connecting the side guide members 64 on the downstream side of the temperature detecting portion 63 in the rotational direction R of the heat roller 26. Accordingly, if a jam occurs in the paper 3 that has been guided further downstream from the thermistor 34 in the rotational direction R, the regulating guide member 65 prevents the jammed paper 3 from being conveyed toward the upstream side (i.e., towards the thermistor 34). Thus, the regulating guide member 65 can prevent the paper 3 that has become jammed from contacting and damaging the temperature detecting portion 63.

The lower edge portion 69 of the regulating guide member 65 is formed to be parallel to the surface 26S of the heat roller 26 and is positioned in the vicinity of the surface 26S at a space that is less than or equal to 1.5 mm. Accordingly, the regulating guide member 65 can reliably prevent the jammed paper 3 from being fed to the upstream side through a gap between the regulating guide member 65 and the surface 26S of the heat roller 26.

Since the side guide member 64 and the regulating guide member 65 are disposed at the cover member 35, the number of components can be reduced and the configuration can be simplified. By installing the cover member 35, positioning of the side guide member 64 and the regulating guide member 65 can be achieved at the same time.

Moreover, since the side guide members 64 and the regulating guide member 65 are formed of plastic integrally with the cover member 35, the side guide members 64 and the regulating guide member 65 can be constructed together with the cover member 35 with a simple construction and with high dimensional accuracy.

In the heat fixing device 19, the control unit 44 controls the temperature of the surface 26S of the heat roller 26 by controlling the heater 43, such that a separation space between the surface 26S and the leading edge of the thinnest paper 3 on which the laser printer 1 can perform printing and fixing is greater than the space L between the separation plate 33 and the surface 26S. Here, the thinnest paper 3 on which the laser printer 1 can perform printing and fixing is determined based on specifications of the laser printer 1, the heat fixing device 19, and the like.

This is because the leading edge of the paper 3 tends to be separated more easily from the surface 26S, as the temperature of the surface 26S increases. Accordingly, the temperature of the surface 26S is selected to ensure that the separation space between the leading edge of the thinnest paper 3 and the surface 26S is greater than the space L between the separation plate 33 and the surface 26S. If the temperature of the surface 26S is controlled to be such a temperature, the paper 3 can be separated reliably from the surface 26S.

More specifically, if the conditions are such that the thickness of the paper 3 is 50 to 450 μm and the space L between the separation plate 33 and the surface 26S satisfies an inequality $0<L\leqq 0.6$ mm, it is appropriate to control the temperature of the surface 26S to be greater than or equal to 175° C.

This can be confirmed from experimental examples below.

<Experimental Examples>

Using a laser printer of the above-described specifications, all-black printing (printing with black over the entire image forming area) was done on 50 sheets of thin paper (FXOS-S) at a print speed of 24 ppm (pages per minute) under the conditions listed below, to confirm whether or not the paper rolled around the heat roller or jammed. The results are listed in a table in FIG. 10.

<Print Conditions>

(1) Two different leading-edge margins: 2 to 3 mm and 1 to 2 mm (the standard value is 4±1 mm).

(2) Two different spaces between the separation plate and the surface of the heat roller; 0.4 to 0.5 mm and 0.7 to 0.8 mm.

(3) Four different fixing temperatures: 165° C., 170° C., 175° C., and 180° C.

Figures 10, 11:
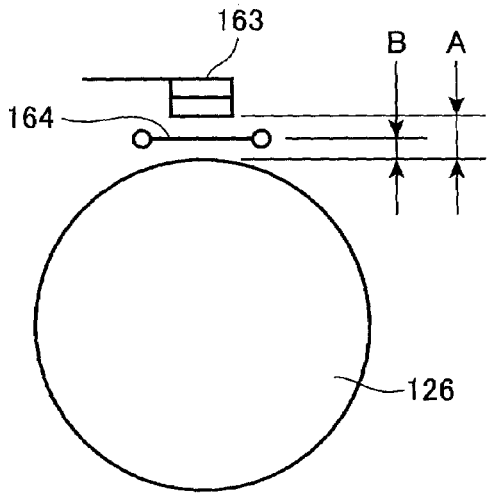
FIG. 10 is a table showing experimental results that confirm whether or not the paper rolled around the heat roller or jammed under several conditions.
FIG. 11 is an explanatory diagram showing a temperature detecting portion of a non-contact-type temperature sensor and a guide member according to a comparative example.

As shown in the table in FIG. 10, at the temperature of 165° C. regardless of the other conditions, the paper wound around the heat roller and jammed. Separation characteristics improved as the temperature increased, and no winding of the paper around the heat roller was seen at 180° C., regardless of the paper leading-edge margin. It is shown that a narrower space between the separation plate and the surface of the heat roller is better, from the separation result observed at the fixing temperature of 175° C., the leading-edge margin of 2 to 3 mm, and the space between the separation plate and the surface of the heat roller of 0.4 to 0.5 mm.

While the invention has been described in detail with reference to the specific embodiment thereof, it would be apparent to those skilled in the art that various changes and modifications may be made therein without departing from the spirit of the invention.

For example, in the, above-described embodiment, the side guide members 64 are disposed on both sides of the temperature detecting portion 63 of the thermistor 34 in the axial direction of the heat roller 26. However, only one side guide member may be provided spaced away from the temperature detecting portion 63 in the axial direction on either side of the temperature detecting portion 63.

In the above-described embodiment, the regulating guide member 65 extends in a direction perpendicular to a direction in which the side guide members 64 extend. However, the regulating guide member 65 may extend in a direction that is not perpendicular to the direction in which the side guide members 64 extend, and may extend in a direction that intersects with the direction in which the side guide members 64 extend.

In the above-described embodiment, the thermistor 34 is a contact-type temperature sensor that has the temperature detecting portion 63 in contact with the surface 26S for detecting the temperature thereof. However, the thermistor may be a non-contact-type temperature sensor such as an infrared temperature sensor.

When a non-contact-type temperature sensor is used, the side guide members 64 according to the present embodiment have the following advantage. That is, as shown in FIG. 11, if a guide member 164 is disposed at an approximate center in an axial direction of a heat roller 126, a temperature detecting portion 163 of a non-contact-type temperature sensor need to be disposed with a space A from a surface 126S of the heat roller 126. Obviously, the space A must be greater than a space B between the guide member 164 and the surface 126S (A>B). However, the side guide members 64 according to the present embodiment are disposed spaced away from the temperature detecting portion 63 in the axial direction of the heat roller 26. Accordingly, the relationship between the spaces A and B does not matter. Therefore, a temperature detecting portion of the non-contact-type temperature sensor can be disposed sufficiently close to the surface 26S of the heat roller 26.

What is claimed is:

1. A fixing device for fixing a developer image onto a fixing medium, the device comprising:

a heating member extending in its axial direction and having a heating surface, the heating surface having a temperature;

a pressure member in pressure contact with the heating member;

a temperature detecting portion disposed confronting the heating surface for detecting the temperature of the heating surface; and at least one guide member disposed adjacent to the heating surface with a predetermined space therebetween and spaced away from the temperature detecting portion in the axial direction, thereby guiding, along the heating surface, the fixing medium that has not been separated from the heating surface and has been conveyed into the vicinity of the temperature detecting portion, wherein:

the heating member and the pressure member confront each other at a nip portion;

the fixing medium enters the nip portion at a first position and comes out of the nip portion at a second position; and the temperature detecting portion is located closer to the second position than to the first position.

2. The fixing device as claimed in claim 1, wherein the at least one guide member comprises a pair of guide members disposed on both sides of the temperature detecting portion in the axial direction.

3. The fixing device as claimed in claim 1, wherein the heating member and the pressure member are rotatable in each rotating direction for pinching and conveying the fixing medium in cooperation with each other; and wherein the heating member and the pressure member fix the developer image on the fixing medium when the fixing medium passes therebetween.

4. The fixing device as claimed in claim 1, further comprising a regulating member disposed downstream of the temperature detecting portion in the rotating direction of the heating member with a space from the heating surface, wherein the at least one guide member extends in a first direction; and wherein the regulating member extends in a second direction that intersects with the first direction.

5. The fixing device as claimed in claim 4, wherein the second direction is substantially perpendicular to the first direction.

6. The fixing device as claimed in claim 4, further comprising a cover member covering the heating member, wherein the at least one guide member and the regulating member are disposed at the cover member.

7. The fixing device as claimed in claim 6, wherein the at least one guide member and the regulating member are formed of a plastic integrally with the cover member.

8. The fixing device as claimed in claim 1, wherein the at least one guide member has an edge portion confronting the heating surface; and wherein the edge portion is formed as a curve along the heating surface.

9. The fixing device as claimed in claim 1, wherein the predetermined space is less than or equal to 1.5 mm.

10. The fixing device as claimed in claim 1, wherein the heating member is in pressure contact with the pressure member at a contact position, the device further comprising:

a support member rotatably supporting the heating member; and a separating member disposed downstream from the contact position in the rotating direction of the heating member and upstream from the temperature detecting portion, the separating member including:

a separating portion confronting the heating surface for separating the fixing medium from the heating surface after the developer image has been fixed onto the fixing medium; and a positioning portion contacting with the support member, thereby maintaining a distance between the separating portion and the heating surface at a predetermined separation distance.

11. The fixing device as claimed in claim 1, further comprising:

a cover member covering the heating member; and a regulating member disposed at the cover member and downstream of the temperature detecting portion in the rotating direction of the heating member with a space from the heating surface, the regulating member extending in a direction that intersects with a direction perpendicular to the axial direction, the regulating member being located closer to the second position than to the first position.

12. The fixing device as claimed in claim 11, wherein the regulating member extends in a direction substantially parallel to the axial direction.

13. The fixing device as claimed in claim 11, wherein the cover member and the regulating member are integrally formed of a plastic.

14. The fixing device as claimed in claim 1, wherein the at least one guide member is located closer to the second position than to the first position.

15. The fixing device as claimed in claim 1, wherein the temperature detecting portion and the at least one guide member overlap with each other in the axial direction when viewed from a vertical direction when the fixing device is disposed in an orientation in which it is intended to be used.

16. A fixing device for fixing a developer image onto a fixing medium, the device comprising:

a heating member extending in its axial direction and having a heating surface, the heating surface having a temperature;

a pressure member in pressure contact with the heating member at a contact position;

a temperature detecting portion disposed confronting the heating surface for detecting the temperature of the heating surface;

a support member rotatably supporting the heating member; and a separating member disposed downstream from the contact position in the rotating direction of the heating member and upstream from the temperature detecting portion, the separating member including:

a separating portion confronting the heating surface for separating the fixing medium from the heating surface after the developer image has been fixed onto the fixing medium; and a positioning portion directly contacting with the support member, thereby maintaining a distance between the separating portion and the heating surface at a predetermined separation distance L.

17. The fixing device as claimed in claim 16, wherein the predetermined separation distance L satisfies a condition of $0<L\leqq 0.6$ mm.

18. The fixing device as claimed in claim 16, further comprising:

a holder member extending in a direction parallel to the axial direction of the heating member, the temperature detecting portion being attached to the holder member; and an urging member generating an urging force for pressing the positioning portion against the support member, allowing the separating member to be fixed to the holder member by the urging force.

19. The fixing device as claimed in claim 18, wherein the separating member confronts the heating member in a confrontation direction; and wherein the holder member includes a reinforcing portion supporting a part of the separating member in the confrontation direction, thereby reinforcing the separating member.

20. The fixing device as claimed in claim 19, wherein each of the reinforcing portion and the part of the separating member has a surface extending substantially perpendicular to the confrontation direction; and wherein the surfaces of the reinforcing portion and the part of the separating member are in contact with and fixed with each other.

21. The fixing device as claimed in claim 18, wherein the holder member includes a holder-member guide portion guiding the fixing medium along the heating surface on an upstream side of the temperature detecting portion in the rotating direction of the heating member.

22. The fixing device as claimed in claim 16, wherein the separating portion has a film shape.

23. The fixing device as claimed in claim 16, wherein the separating member has adhesion prevention treatment for preventing adhesion of developer.

24. The fixing device as claimed in claim 16, wherein the separating member is formed by cutting by a pressing process and has a front surface and a back surface opposite to the front surface, the front surface being defined as a surface that comes into contact with a cutting blade first during the pressing process; and wherein the separating member is disposed such that the back surface confronts the heating surface.

25. The fixing device as claimed in claim 16, further comprising at least one guide member disposed adjacent to the heating surface with a predetermined space therebetween and spaced away from the temperature detecting portion in the axial direction, thereby guiding, along the heating surface, the fixing medium that has not been separated from the heating surface and has been conveyed into the vicinity of the temperature detecting portion.

26. The fixing device as claimed in claim 25, further comprising a regulating member disposed downstream of the temperature detecting portion in the rotating direction of the heating member with a space from the heating surface, wherein the at least one guide member extends in a first direction; and wherein the regulating member extends in a second direction that intersects with the first direction.

27. The fixing device as claimed in claim 16, further comprising a control unit controlling the temperature of the heating surface such that a space at the separating member between the heating surface and a leading edge of the thinnest fixing medium for which fixing can be performed is greater than a space between the heating surface and the separating member, allowing the separating member to separate the leading edge of the thinnest fixing medium from the heating surface.

28. The fixing device as claimed in claim 16, wherein the positioning portion maintains a fixed distance between the separating portion and the heating surface at the predetermined separation distance L.

29. A fixing device for fixing a developer image onto a fixing medium, the device comprising:

a heating member extending in its axial direction and having a heating surface, the heating surface having a temperature;

a pressure member in pressure contact with the heating member;

a temperature detecting portion disposed confronting the heating surface for detecting the temperature of the heating surface;

a cover member covering the heating member; and at least one guide member disposed at the cover member and adjacent to the heating surface with a predetermined space therebetween, thereby guiding, along the heating surface, the fixing medium that has not been separated from the heating surface and has been conveyed into the vicinity of the temperature detecting portion, wherein:

the heating member and the pressure member confront each other at a nip portion;

the fixing medium enters the nip portion at a first position and comes out of the nip portion at a second position; and the at least one guide member is located closer to the second position than to the first position.

30. The fixing device as claimed in claim 29, wherein the cover member and the at least one guide member are integrally formed of a plastic.

31. The fixing device as claimed in claim 29, wherein the temperature detecting portion is located closer to the second position than to the first position.

32. The fixing device as claimed in claim 29, wherein the temperature detecting portion and the at least one guide member overlap with each other in the axial direction when viewed from a vertical direction when the fixing device is disposed in an orientation in which it is intended to be used.

33. An image forming device comprising:

an image bearing member bearing a developer image formed by developing an electrostatic latent image;

a transfer unit transferring the developer image borne on the image bearing member to a fixing medium; and a fixing device including:

a heating member extending in its axial direction and having a heating surface, the heating surface having a temperature;

a pressure member in pressure contact with the heating member;

a temperature detecting portion disposed confronting the heating surface for detecting the temperature of the heating surface; and at least one guide member disposed adjacent to the heating surface with a predetermined space therebetween and spaced away from the temperature detecting portion in the axial direction, thereby guiding, along the heating surface, the fixing medium that has not been separated from the heating surface and has been conveyed into the vicinity of the temperature detecting portion, wherein:

the heating member and the pressure member confront each other at a nip portion;

the fixing medium enters the nip portion at a first position and comes out of the nip portion at a second position; and the temperature detecting portion is located closer to the second position than to the first position.

34. The image forming device as claimed in claim 33, wherein the at least one guide member is located closer to the second position than to the first position.

35. The image forming device as claimed in claim 33, wherein the temperature detecting portion and the at least one guide member overlap with each other in the axial direction when viewed from a vertical direction when the image forming device is disposed in an orientation in which it is intended to be used.

* * * * *